United States Patent [19]

Rising et al.

[11] 4,081,104

[45] Mar. 28, 1978

[54] CONTAINER END MEMBER WITH AN INTEGRAL HINGED OPENING TAB HAVING INDENTATION THEREON

[75] Inventors: Paul Eugene Rising, Arvada; James Wendell Jensen, Boulder, both of Colo.; Harold Cook, Jr., Long View, Wash.

[73] Assignee: Coors Container Company, Golden, Colo.

[21] Appl. No.: 800,206

[22] Filed: May 25, 1977

[51] Int. Cl.[2] ..... B65D 41/32

[52] U.S. Cl. ..... 220/268; 220/271

[58] Field of Search ..... 220/266–273; 113/121 C

[56] References Cited

U.S. PATENT DOCUMENTS

| | | | |
|---|---|---|---|
| 3,929,251 | 12/1975 | Urmston | 220/268 |
| 3,982,657 | 9/1976 | Keller et al. | 220/268 |

*Primary Examiner*—George T. Hall

*Attorney, Agent, or Firm*—Bruce G. Klaas

[57] ABSTRACT

A one piece container end member of metallic sheet material having an exterior rim portion for mounting on an open ended container member; a central wall portion surrounded by the exterior rim portion and extending generally radially inwardly relative thereto for closing the open end of the container body member; an integral inwardly severable and displaceable tab portion in the central wall portion extending generally radially inwardly from the exterior rim portion; the tab portion being hingedly integrally connected to the central wall portion by a generally arcuately extending hinge portion; the tab portion being defined by at least one continuous score groove extending from arcuately spaced points adjacent the interior rim portion on opposite sides of the hinge portion generally radially inwardly therefrom toward the central axis of the container end member with intermediate score groove portions extending along substantially straight lines and being connected adjacent the central axis by a curved intermediate score groove portion; the tab portion within the score groove having indentation means in the form of a continuous formed wall portion extending generally transversely thereto and defining a flat wall portion therewithin, which have a first generally circular section next adjacent the hinge area and a second circular section next adjacent the central axis and a pair of curved connected sections extending therebetween.

12 Claims, 6 Drawing Figures

CONTAINER END MEMBER WITH AN INTEGRAL HINGED OPENING TAB HAVING INDENTATION THEREON

BACKGROUND AND SUMMARY OF INVENTION

This invention relates to a new and improved container end member. More particularly, the invention relates to a one piece container closure, such as a can end member or a bottle cap or the like made of one piece of metallic sheet material adapted to be associated with a container body member, such as a metallic can of two or three piece construction or glass or plastic bottles or the like, to close one end thereof to provide a container member for goods and having an integral tab portion in the container end member defined by severable score groove means so as to be axially inwardly displaceable to provide access to the contents of the container, such as disclosed in U.S. Pat. No. 3,982,657.

The present invention provides a new and improved container end member in which the tab portion is provided with formed indentation means to facilitate the manufacture thereof while also providing for more uniform results relating to the maintenance of a sealed relationship between the tab portion and the container end member and relating to opening of the container during severing the tab portion from the container end member with application of relatively small force at particular locations. In general, the formed indentation means of the present invention comprises a continuous formed generally transversely extending side wall portion, which is laterally inwardly spaced from the score groove means and connected thereto by a continuous flange portion, and a generally flat bottom wall portion within the formed side wall portion. The formed side wall portion and the bottom wall portion have hourglass shaped peripheral configurations including first and second generally circular sections tangentially interconnected by curved intermediate connecting sections.

BRIEF DESCRIPTION OF DRAWING

The foregoing objectives and results have been attained in an illustrative and presently preferred embodiment of the inventive concepts shown on the accompanying drawings in which.

DETAILED DESCRIPTION

Figure 1:
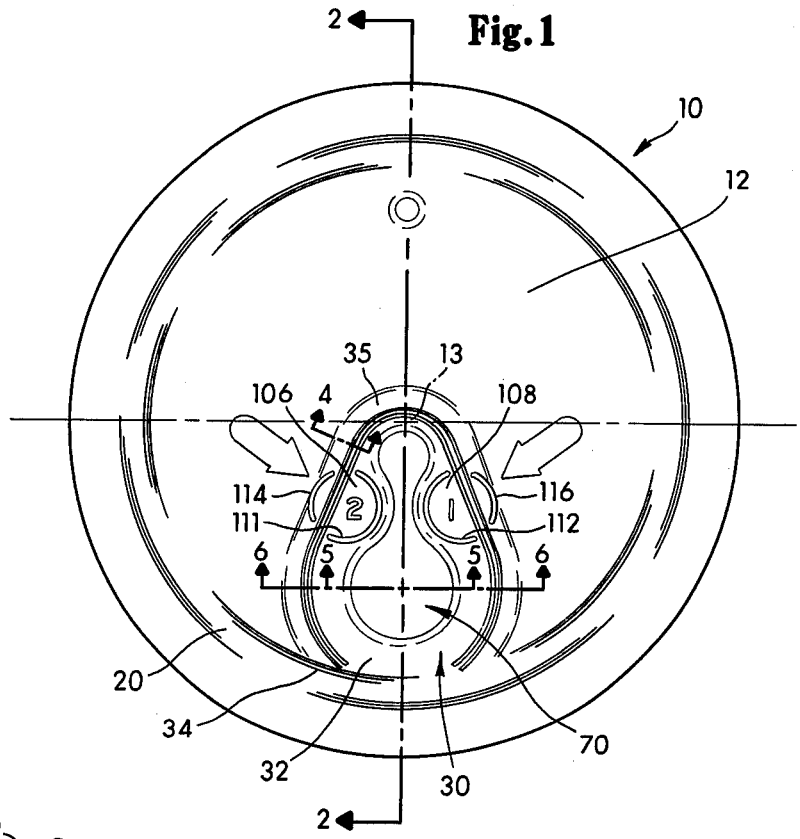
FIG. 1 is a top plan view of a container end member after manufacture and prior to assembly with a container body member.
Figure 2:
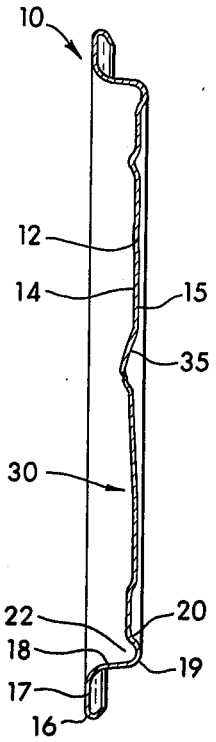
FIG. 2 is a cross-sectional view of the container end member of FIG. 1 taken along the line 2—2.

Referring now to FIGS. 1 and 2, a one piece container end member 10 formed from a blank of sheet metal material such as, for example, an aluminum alloy of approximately 0.0115 inch thickness, is shown to comprise a central annular end wall portion 12, extending radially transversely at substantially right angles to a central axis 13 to provide outer and inner container surfaces 14, 15 when in association with a can body member. In the presently preferred embodiment, center portion 12 is axially inwardly offset from an annular exterior rim portion 16 having an axially outwardly facing end surface 17 and integrally connected thereto by a generally axially slightly radially inwardly extending flange portion 18, a rounded interior rim portion 19 located axially inwardly beyond the center portion 12, and a generally radially inwardly slightly axially extending inclined flange portion 20 defining an annular axially outwardly opening groove 22 between flange portion 18 and center portion 12. While there are certain advantages in the aforedescribed arrangement of the presently preferred embodiment, it is to be understood that the center portion 12 may be variously otherwise connected to the rim portion 16 by any suitable connecting flange portion structure.

Figure 3:
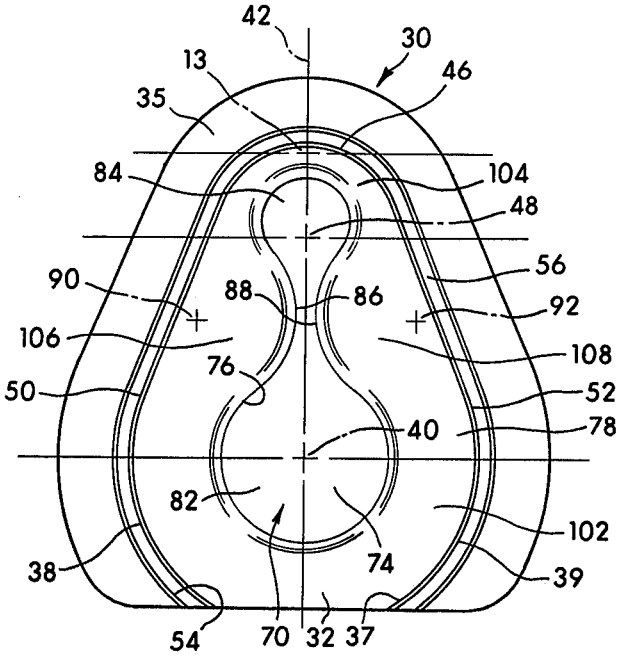
FIG. 3 is an enlarged plan view of the tab portion of the container end member of FIG. 1.
Figure 4:
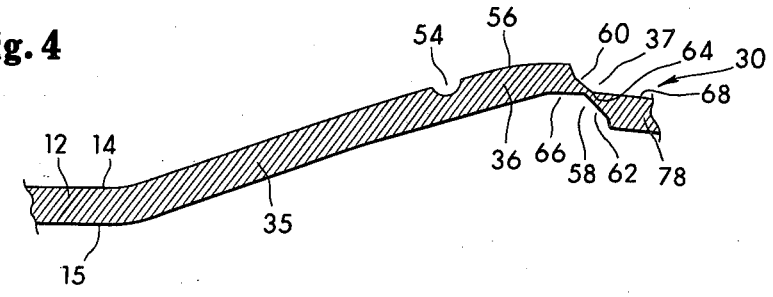
FIG. 4 is an enlarged cross-sectional view of an edge part of the tab portion of the container end member of FIG. 1 taken along line 4—4.
Figure 5:
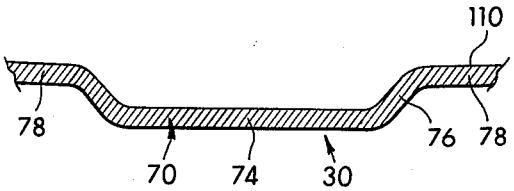
FIG. 5 is an enlarged cross-sectional view of a center part of the tab portion of the container end member of FIG. 1 taken along line 5—5.

Container opening means are provided in center portion 12 in the form of a partially severable tab portion 30 having a relatively wide hinge area 32 extending generally arcuately along the juncture 34 of flange portion 20 with center portion 12, FIG. 1. Tab portion 30 is connected to center portion 12 by an axially outwardly inclined flange portion 35 which terminates in a rim portion 36, FIG. 4, with the tab portion being axially inwardly offset relative thereto. As shown in FIGS. 3 and 4, the peripheral configuration of tab portion 30 is defined by a first peripherally interior score line groove 37 in outside surface 14 of center portion 12, generally located at the juncture between tab portion 30 and rim portion 36. Groove 37 comprises opposite radially outermost arcuate portions 38, 39 having a common center at 40 on a radial line 42 extending from the central axis 13 of the end member 10; an arcuate radially innermost portion 46 extending slightly beyond the central axis 13 and having a center at 48 on radial line 42; and opposite generally radially extending straight line portions 50, 52 tangentially connected to arcuate portions 38, 39, 46. A second peripherally exterior score line groove 54 may be provided in the outside surface 14 of center portion 12 in outwardly spaced relationship to groove 37 beyond the juncture of flange portion 35 and rim portion 36 to provide a relatively narrow width land area 56 therebetween. The groove 54 and land area 56 have the same general contour as groove 37 so as to extend thereabout in spaced generally parallel relationship therewith. A third score line groove 58, FIG. 4, of the same peripheral configuration as score line groove 37, is located at the juncture of rim portion 36 and tab portion 30 in interior surface 15 of center portion 12.

As shown in FIG. 4, score line grooves 37, 58 are located in juxtaposition to provide generally parallel inclined surfaces 60, 62, the inner end portions of which may slightly overlap to define a shear area 64, having a relatively narrow width transverse to surfaces 60, 62, with the adjacent inner surface 66 of the rim portion 36 being substantially parallel to and slightly inwardly offset relative to the adjacent outer surface 68 of the tab portion 30.

Figure 6:
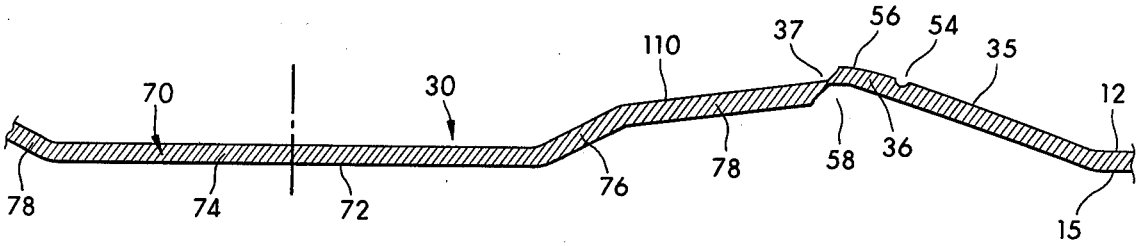
FIG. 6 is an enlarged cross-sectional view of an edge part and center part of the tab portion of the container end member of FIG. 1 taken along the line 6—6.

As shown in FIG. 6, the tab portion 30 is axially inwardly offset relative to the rim portion 36 with indentation means 70 in the central portion along the radial line 42 being furthest axially inwardly displaced such that the innermost surface area 72 is generally located approximately in coplanar relationship with the inner surface 15 of the center portion 12.

Referring to FIGS. 3 and 6, in general, the presently preferred form of the indentation means 70 has an hour-glass peripheral configuration, and comprises a generally flat bottom wall portion 74, and a continuous formed side wall portion 76 which is slightly inclined and extends generally transversely between the bottom wall portion 74 and a generally flat slightly inclined flange portion 78 extending between the side wall portion 76 and the score grooves 37, 58. The continuous formed side wall portion 76 and the bottom wall portion 74 have peripheral configurations comprising a first generally circular relatively large section 82 located next adjacent the hinge portion 32 with a radius of curvature having a center at 40 on line 42; a second generally circular relatively small section 84 spaced radially inwardly of the first circular section 82 and located next adjacent the central axis 13 with a radius of curvature having a center at 48; and a pair of spaced oppositely curved intermediate connecting sections 86, 88 which extend between and connect the first and second circular sections 82, 84, with radii of curvature having centers at 90, 92. The connecting sections 86, 88 and the circular sections 82, 84 are tangentially connected. The configuration of the indentation means is such as to provide a variable width for connecting flange portion 78 which includes a generally circular relatively wide portion 102 circumjacent circular bottom wall portion 82, a generally circular relatively narrow width portion 104 circumjacent circular bottom wall portion 84, and a pair of enlarged sector portions 106, 108 next adjacent the intermediate straight line portions 50, 52 of the score groove 38.

Thus, in the presently preferred embodiment, the generally flat upper surface 110 of flange portion 78 provides a continuous land area between the side wall portion 76 of the indentation means and the score groove 37 including a pair of oppositely spaced enlarged land area sector portions at 106, 108 which are utilized to provide first and second pressure applying surfaces for initial severance of the score groove 37 along the intermediate straight line portions 50, 52. As shown in FIG. 1, arcuate ribs 111, 112 may be embossed on the land area sector portions 106, 108 and arcuate ribs 114, 116 may be embossed on the flange portion 35 to define and locate the portions of the score groove 37 to be initially pressed to initially sever the tab portion 30 relative to the end wall portion 12. Suitable indicia such as the arrows, instructions, and numerals, as shown in FIG. 1, may be embossed on the end wall portion 12 to inform the consumer about the preferred opening procedures.

In general, the aforedescribed indentation means is constructed and arranged for strengthening and rigidifying the tab portion, to facilitate the manufacture and assembly of the end member 10, and to prevent premature opening of the tab portion during manufacture, assembly, and handling and storage after assembly with a can body member. A particular advantage is the prevention of outward deflection of the tab portion by internal pressure of the filled and sealed container which may otherwise cause outward deflection such as to fracture the score grooves 37, 58. Another particular advantage is that the rigidifying effect on the central part of the tab portion enables the score grooves to be more easily fractured by axially inwardly directed forces when it is desired to open the container. In addition, the specific configuration of the indentation means 70 provides specific opening positions along the score groove means which may be readily identifiable by embossed directions and indicia. If such directions and indicia are not required, the configuration of the indentation means may be modified as, for example, by connecting curved end portions 82, 84 with straight intermediate portions in place of curved intermediate portions 86, 88.

While it is contemplated that other and alternative configurations of indentation means may be employed to practice the inventive concepts with the present tab configuration or with other tab configurations, the particular hour-glass configuration disclosed hereinbefore is particularly well suited for practice of the inventive concepts with the particular tab configuration as disclosed herein. Thus, it is intended that the following claims be construed to include various other arrangements and configurations except insofar as limited by the prior art.

What is claimed is:

1. A container end member, or the like for sealed association with a container member to provide a sealed container, comprising:

a generally annular one piece sheet of material having a central axis;

an outer annular rim portion for sealed association with the container body member;

a central end wall portion integrally connected to said rim portion and extending generally transversely relative to said central axis; and a severable and displaceable tab portion in and integrally connected to said central end wall portion having:

an integral hinge portion having circumferentially spaced opposite ends and being located adjacent said outer annular rim portion and extending in generally circumferentially parallel closely spaced relationship relative thereto;

severable score groove means defining a severable wall portion for severing said tab portion from said central wall portion by axially inwardly directed forces, said score groove means and said severable wall portion extending from said opposite ends of said hinge portion generally radially inwardly relative to said outer annular rim portion toward said central axis and being located in part closely adjacent said central axis and defining a radially elongated and circumferentially extending tab portion area axially inwardly displaceable relative to said central end wall portion by pivotal movement about said hinge portion to provide an opening for the container having a vent portion adjacent said central axis and a pouring portion adjacent said rim portion; and indentation means formed in said severable wall portion of said tab portion located in inwardly spaced relationship to said severable score groove means for strengthening and rigidifying said tab portion and for preventing outward deflection by internal pressure and for facilitating severance of the tab portion by fracture along the score groove means.

2. The invention as defined in claim 1 and wherein said indentation means comprising:

a continuous formed side wall portion extending axially inwardly generally transversely relative to said tab portion.

3. The invention as defined in claim 2 and wherein said indentation means further comprising:

a generally flat bottom wall portion within said formed side wall portion extending generally parallel to said central end wall portion.

4. The invention as defined in claim 3 and wherein said continuous formed side wall portion and said bottom wall portion having a peripheral configuration comprising:

a first circular section located next adjacent said hinge portion;

a second circular section spaced radially inwardly of said first circular section and located next adjacent said central axis; and a pair of spaced intermediate connecting sections which connect and extend between said first circular section and said second circular section.

5. The invention as defined in claim 4 and wherein:

said intermediate connecting sections tangentially intersect and form continuations of said first circular section and said second circular section.

6. The invention as defined in claim 5 and wherein: said severable score groove means comprising:

a pair of circumferentially spaced substantially straight portions extending generally radially between said hinge portion and said central axis;

a pair of circumferential spaced curved end portions adjacent said hinge portion; and said first circular section and said curved end portions having a common center of curvature.

7. The invention as defined in claim 6 and wherein:

said severable score groove means further comprising a curved end portion connecting said straight portions generally radially inwardly opposite said hinge portion; and said second circular section and said curved end portion having a common center of curvature.

8. The invention as defined in claim 7 and wherein:

the radius of curvature of said first circular section being greater than the radius of curvature of said second circular section.

9. The invention as defined in claim 8 and wherein:

said pair of spaced curved end portions and said first circular section having a common center located on a radial line extending outwardly from said central axis and being circumferentially spaced midway between said straight portions; and said curved end portion and said second circular section having a common center located on said radial line.

10. The invention as defined in claim 9 and wherein:

said straight portions extending tangentially relative to said curved end portion and said pair of spaced curved end portions; and said connecting sections being oppositely curved and extending inwardly toward one another and having centers of curvature located approximately midway between the intersections of said straight portions with curved end portion and said pair of spaced curved end portions.

11. The invention as defined in claim 10 and further comprising:

a continuous land area extending between said continuous formed side wall portion and said score groove means.

12. The invention as defined in claim 11 and further comprising:

a pair of enlarged land area portions located adjacent said pair of intermediate sections; and a pair of generally circular opening force application surface portions each including a sector portion within one of said enlarged land area portions located next adjacent and inwardly of an intermediate section of one of said space substantially straight portions of said score groove means.

* * * * *